US005884561A

United States Patent [19]

Thünker et al.

[11] Patent Number: 5,884,561

[45] Date of Patent: Mar. 23, 1999

[54] METHOD AND DEVICE FOR RELEASING A SHEET FROM A BLANKET CYLINDER OF A PRINTING MACHINE

[75] Inventors: Norbert Thünker, Hirschberg; Axel Hauck, Karlsruhe, both of Germany

[73] Assignee: Heidelberger Druckmaschinen AG, Heidelberg, Germany

[21] Appl. No.: 831,579

[22] Filed: Apr. 9, 1997

[30] Foreign Application Priority Data

Apr. 9, 1996 [DE] Germany ..... 196 13 963.5

[51] Int. Cl.[6] ..... B41F 1/28

[52] U.S. Cl. ..... 101/483; 101/409; 101/415.1

[58] Field of Search ..... 101/409, 410, 101/415.1, 483

[56] References Cited

U.S. PATENT DOCUMENTS

| | | | |
|---|---|---|---|
| 2,822,754 | 2/1958 | Huck | 101/415.1 |
| 4,697,512 | 10/1987 | Simeth | 101/410 |
| 4,759,290 | 7/1988 | Holl et al. | 101/415.1 |
| 4,813,353 | 3/1989 | Raab et al. | 101/415.1 |
| 5,259,312 | 11/1993 | Simeth et al. | 101/415.1 |
| 5,303,650 | 4/1994 | Wieland | 101/409 |
| 5,642,669 | 7/1997 | Becker | 101/415.1 |

FOREIGN PATENT DOCUMENTS

3220364A1 12/1983 Germany .

4308595A1 9/1994 Germany .

*Primary Examiner*—Edgar Burr
*Assistant Examiner*—Leslie Grohusky
*Attorney, Agent, or Firm*—Laurence A. Greenberg; Herbert L. Lerner

[57] ABSTRACT

A method of releasing a sheet from a blanket cylinder of a printing machine, wherein the sheet is guided by an impression cylinder and held by grippers thereof, includes moving, with respect to the impression cylinder, elements of the impression cylinder holding the sheet, in a direction relatively counter to the direction of rotation of the impression cylinder, so as to produce an enlarged pull-off angle after a leading edge of the sheet has passed a printing nip between the blanket and the impression cylinders; and a device for performing the foregoing method. The background to the invention is the knowledge that higher tensile forces on a sheet are disadvantageous, and the object was therefore set of making available a method and a device in which the tensile force is reduced. This is achieved by means of a method in which, in order to produce an enlarged pull-off angle (γ) after the leading edge of the sheet (1) has passed the press nip (6), the elements (5,5',5",5"') of the impression cylinder (4) which hold the sheet (1) are moved in relation to the impression cylinder (4), relatively counter to its direction of rotation (15). Furthermore, the object is achieved by means of a device in which the elements (5,5',5",5"') holding the sheet (1) are configured so as to be correspondingly movable.

18 Claims, 2 Drawing Sheets

METHOD AND DEVICE FOR RELEASING A SHEET FROM A BLANKET CYLINDER OF A PRINTING MACHINE

BACKGROUND OF THE INVENTION

FIELD OF THE INVENTION

The invention relates to a method and a device for releasing a sheet from a blanket cylinder of a printing machine, wherein the sheet is guided by the impression cylinder and held by grippers thereof.

In offset printing, ink is applied by a plate cylinder to a blanket cylinder and is, in turn, printed by the latter onto a sheet located on an impression cylinder. The application of ink to the sheet occurs at a line of contact between the blanket cylinder and the impression cylinder. This is called the printing nip. Adhesion forces are produced between the sheet and the blanket cylinder by the ink, causing the sheet to adhere to the blanket cylinder. After a given adhesion length or distance on the blanket cylinder, a tear-off line is reached at which the sheet is pulled away from the blanket cylinder. The angle at the blanket cylinder between the printing nip and the tear-off line is called the follower or co-rotation angle and is usually about 5°. The greater the follower angle, the greater is also the pull-off angle, which is the angle that the paper sheet forms at the tear-off line to the tangent to the blanket cylinder. This run-on of the sheet has been considered to be disadvantageous in the state of the prior art, and measures have been devised to reduce this sheet run-on, due to which the pull-off angle has been reduced.

Thus, the published German Patent Document DE 43 08 595 A1 addresses the objective of developing a method and a device for reducing the sheet run-on, which permit the sheet to be tautened to as far as the printing nip. For this purpose, this German patent document proposes that the circumferential speed be set in such a manner that the tensile forces on the sheet are as high as possible after the sheet leading edge has passed the printing nip.

The published German Patent Document DE 32 20 364 A1 also follows such a path. The objective thereof is to make a sheet tensioning device available which displaces the tear-off line of the sheet from the cylinder as closely as possible to the printing zone. For this purpose, the gripper system on the impression cylinder has been equipped with spring-controlled and cam-controlled levers, which permit the gripper system to be locked in a specific position and to be unlocked at a later time, in order to apply a tensile stress to the sheet in the running or travel direction thereof. Thus, the tensile stress which acts upon the sheet in any case was additionally increased after the sheet leading edge passed the printing nip, in that a high spring force was released, which additionally tautens the sheet. What was intended to be achieved in this manner was that the tearing line of the sheet be displaced as closely as possible to the printing zone, in order to avoid, as best as possible, the adhesion of the sheet to the blanket cylinder.

The disadvantage of this operating method and of the corresponding devices, respectively, is that measures which are directed to displacing the tear-off line as close as possible to the printing nip lead to the result that the pull-off angle is reduced and, accordingly, the tensile force which acts upon the sheet must be increased in order to attain the force component which is necessary for the release of the sheet. Increasing the forces acting upon the sheet leads to a great mechanical effort having to be expended in order to equip the grippers with adequately high holding forces. In addition, this leads to the production of markings by the grippers on the paper sheet, or the paper sheet being deformed by the increased tensile forces which, in turn, has a detrimental effect upon the printing quality due to the occurrence of ghosting. Also, in spite of the high gripper forces, it is often not possible to prevent the paper sheet from being drawn out from the grippers a given distance which, in turn, has the aforementioned negative influence upon the printing result.

SUMMARY OF THE INVENTION

It is accordingly an object of the invention to provide a method and a device for releasing a sheet from a blanket cylinder of a printing machine wherein the tensile force on the sheet is reduced.

With the foregoing and other objects in view, there is provided, in accordance with one aspect of the invention, a method of releasing a sheet from a blanket cylinder of a printing machine, wherein the sheet is guided by an impression cylinder and held by grippers thereof, which comprises moving, with respect to the impression cylinder, elements of the impression cylinder holding the sheet, in a direction relatively counter to the direction of rotation of the impression cylinder, so as to produce an enlarged pull-off angle after a leading edge of the sheet has passed a printing nip between the blanket and the impression cylinders.

In accordance with another mode, the method of the invention includes performing the movement of the elements over a predetermined travel distance.

In accordance with a further mode of the method, the travel distance over which the elements are moved is dependent upon the cylinder geometry and the nature of the printed material.

In accordance with an added mode of the method, the travel distance is at least 0.2 mm.

In accordance with an additional mode, the method of the invention includes performing the movement of the elements with a tensile force of the sheet and counter to an oppositely directed force.

In accordance with yet another mode of the method, the movement of the elements is controlled.

In accordance with another aspect of the invention, there is provided a device for releasing a sheet from a blanket cylinder of a printing machine, wherein the sheet is guided by an impression cylinder and held by grippers of the impression cylinder, comprising holding elements disposed on the impression cylinder for holding the sheet, the elements being movable, with respect to the impression cylinder, in a direction relatively counter to the direction of rotation of the impression cylinder, so as to produce an enlarged pull-off angle after the leading edge of the sheet has passed a printing nip between the blanket and the impression cylinders.

In accordance with another feature of the invention, the holding elements are constructed so as to be movable over an adjustable travel distance.

In accordance with a further feature of the invention, the sheet-releasing device includes a control device for impressing a movement onto the holding elements in the direction relatively counter to the direction of rotation of the impression cylinder.

In accordance with an added feature of the invention, the holding elements are movable by a tensile force of the sheet counter to a spring force.

In accordance with an additional feature of the invention, the sheet-releasing device includes an adjustable stop for limiting movement of the holding elements.

In accordance with yet another feature of the invention, the sheet-releasing device includes gripper seats for the grippers, the grippers and the gripper seats being pivotable.

In accordance with yet a further feature of the invention, the grippers and the gripper seats are equipped with displaceable holding blocks.

In accordance with yet an added feature of the invention, the sheet-releasing device includes gripper seats for the grippers, the gripper seats being movable and being formed, opposite the grippers, with holding surfaces having a higher static friction than that of the sheet.

In accordance with yet an additional feature of the invention, the gripper seats are pivotable.

In accordance with still another feature of the invention, the gripper seats are of yieldable or sprung construction.

In accordance with still a further feature of the invention, the sheet-releasing device includes a stop for limiting movement of the sheet holding elements in a sheet travel direction.

In accordance with a concomitant feature of the invention, the stop is adjustable.

More specifically with respect to the method according to the invention which is of the type mentioned at the introduction hereto, it is an object of the invention to produce an enlarged pull-off angle after the leading edge of the sheet has passed the printing nip, the elements of the impression cylinder which hold the sheet being moved with respect to the impression cylinder, relatively opposite to the direction of rotation thereof.

Furthermore, with respect to the device according to the invention which is of the type mentioned at the introduction hereto, it is an object of the invention to produce an enlarged pull-off angle after the leading edge of the sheet has passed the printing nip, the elements of the impression cylinder which hold the sheet being configured so as to be movable with respect to the impression cylinder, relatively opposite to the direction of rotation thereof.

The invention is based on the knowledge that a sheet can only be pulled off from the blanket cylinder when a specific angle, which must be greater than 0°, is maintained between the blanket cylinder surface and the pull-off direction. The result of this condition is therefore that at 0° an infinitely high tensile force would have to act on the sheet. As the pull-off angle is enlarged, the necessary tensile force on the sheet is reduced. Because high tensile forces are subject to the disadvantages mentioned at the introduction hereto, and adherence of the sheet to the blanket cylinder is unavoidable, the invention is based on the fact that the path of development previously followed went in the wrong direction and, in contrast with the proposals according to the prior art, this unavoidable effect not only has to be tolerated, but the sheet must be allowed to run on deliberately, in order to achieve a specific pull-off angle, which leads to a limitation of the tensile force on the sheet. In this manner, the forces of the grippers can be reduced, and markings are no longer produced on the paper. In addition, expansion or stretching of the paper and pulling of the paper out of the elements fixing the sheet position are prevented. By preparing or making the paper ready to form the follower or co-rotation angle, it is also possible to provide conditions which occur in the same manner in each sheet and which therefore cannot lead to ghosting or to register errors. This is not the case in the measures mentioned at the introduction hereto, which proceed in the direction of an increase in the tensile forces. The movement of the elements holding the sheet with respect to the impression cylinder, relatively counter to the direction of rotation thereof, can be performed in various ways:

A movement can be carried out by the tensile force of the sheet counter to spring force, or it is possible to move the gripper system in a defined way by mechanical, electrical, pneumatic, magnetic or similar drives, for example piezoelectric elements. Because this movement is identical in the case of each sheet, this has no negative influence on the printing result.

The movement of the elements holding the sheet, which is carried out with respect to the impression cylinder relatively counter to the direction of rotation thereof, is expediently over a predetermined travel distance which depends upon the cylinder geometry and the nature or condition of the printed material. This travel distance is preferably at least 0.2 mm, but can also be larger; a good effect was achieved at 0.5 mm on a pilot machine. Such a predetermined travel distance ensures identical relationships in the case of each sheet and, therefore, good, constant printing quality. The movement of the elements holding the sheet can be carried out by a controller or control system. In the configuration according to the device of the invention with respect to the mobility of the elements holding the sheet, provision can be made for the travel distance traversed in accordance with the movement to be adjustable, for example, by an adjustable stop. However, provision can also be made for the travel distance traversed by the elements holding the sheet to be prescribed by a control device. Such a control device can effect a defined displacement or rotation of the elements holding the sheet.

An expedient exemplary embodiment provides that this movement be performed counter to a force, for example, a spring force, springs being arranged between the gripper seats and the impression cylinder. The gripper seats are moved by the tensile force on the sheet with respect to the impression cylinder, relatively counter to the direction of rotation thereof, it being possible for an adjustable stop to be provided by which this movement can be limited.

The movement of the elements holding the sheet can be performed in various ways. Thus, it is possible for the grippers to be pivotable together with the gripper seats. However, provision can also be made for the grippers and the gripper seats to be equipped with displaceable holding blocks. The displacement of the holding blocks can, in turn, be performed by a controller or control system, for example, employing piezoelectric elements, or counter to the force of springs, with stops limiting the displacement. However, provision can also be made for only the gripper seat to be constructed so that it is movable and to be formed, opposite the gripper, with a holding surface having a higher static friction than that of the sheet. A further possibility is for the gripper seat to be pivotable and, again, springs and stops may be provided. Instead of such springs, however, the gripper seat itself can also be of sprung or yielding construction.

The movement of the sheet-holding elements in the sheet running or travel direction, i.e., the restoring movement, is also expediently limited by a stop. The purpose thereof is always to ensure the same position of the grippers when a sheet is gripped. Of course, this stop can also be of adjustable construction.

Other features which are considered as characteristic for the invention are set forth in the appended claims.

Although the invention is illustrated and described herein as a method and device for releasing a sheet from a blanket cylinder of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
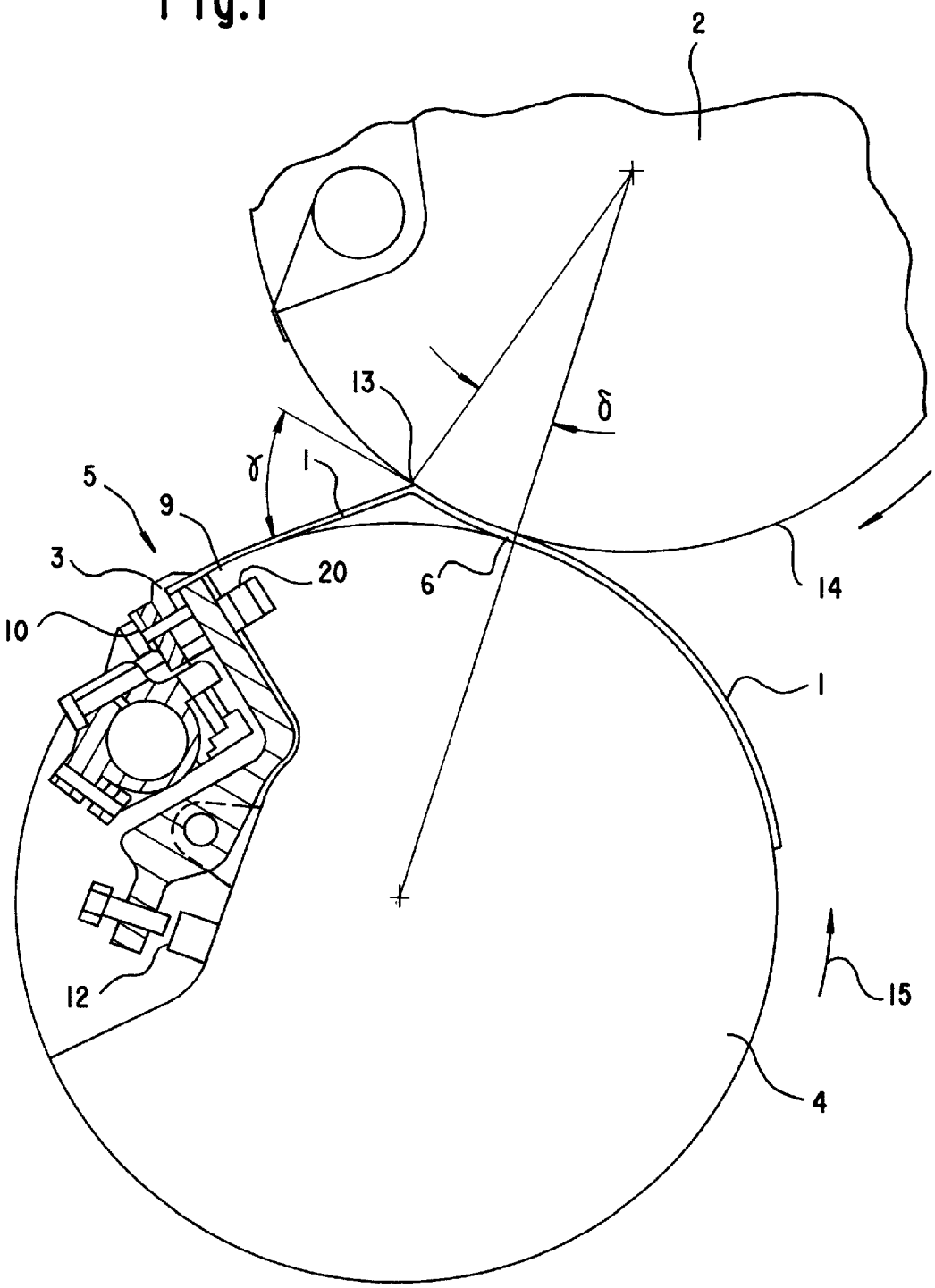
FIG. 1 is a diagrammatic side elevational view, partly in section and partly broken away, of a blanket cylinder and an impression cylinder assembly including a sheet-releasing device according to the invention.

Referring now to the drawings and, first, particularly to FIG. 1, thereof, there is shown therein an assembly of a blanket cylinder 2 and an impression cylinder 4 having a device according to the invention. The rubber blanket 14 of the blanket cylinder 2 receives an ink application from a non-illustrated plate cylinder, the ink application on the rubber blanket 14 is, in turn, applied at a printing nip 6, located between the blanket and impression cylinders 2 and 4, to a sheet 1 which is disposed on the impression cylinder 4 and is held at a leading edge thereof by grippers 3. Because of the adhesion forces of the ink, the sheet 1 remains stuck to the rubber blanket 14 of the blanket cylinder 2 after the printing nip 6 and is pulled off only at a tearing line 13 which is offset by a follower or co-rotation angle $\delta$ with respect to the printing nip 6. The effect thereof is that the sheet 1 is pulled off from the surface of the blanket cylinder 2 at a pull-off angle $\gamma$. If the sheet 1 were to have been pulled off earlier in the printing nip 6, this pull-off angle $\gamma$ would have been equal to 0°. However, this is not possible, because then no force component is present for pulling off the sheet. The invention seeks to avoid the situation wherein the forces which act upon the sheet 1 become great because, otherwise, the disadvantages mentioned at the introduction hereto then arise. For this reason, the elements holding the sheet, namely, the grippers 3 with the gripper seats 10, in the illustrated embodiment of FIG. 1, are configured in such a manner that, after the leading edge of a sheet 1 has passed the printing nip 6, those sheet-holding elements 5 are moved with respect to the impression cylinder 4, relatively counter to the direction of rotation thereof as represented by the arrow 15. An enlarged pull-off angle $\gamma$ is thereby attained, with which the tensile forces on the sheet, which are necessary for pulling off the sheet, are reduced. For this purpose, the grippers 3 are mounted so that they can pivot with the gripper seats 10 and are supported by springs 20 on the impression cylinder 4. During the gripping of a sheet 1, which is not illustrated but occurs before the sheet 1 has passed the printing nip 6, the stop 12 makes contact, due to which the grippers 3 have a defined sheet transfer position. When the leading edge of the sheet 1 passes the printing nip 6, the aforedescribed adhesion of the sheet 1 to the blanket cylinder 2 occurs, and the sheet 1 pulls the grippers 3 with respect to the impression cylinder 4, relatively counter to the direction of rotation 15 thereof. The grippers 3 with the gripper seats 10 are thereby pivoted, and in so doing lifts off the stops 12. This pivoting can be limited by a stop 9, which can be constructed so as to be adjustable (not shown here). This pivoting causes the movement of the elements 5 holding the sheet with respect to the impression cylinder 4, relatively counter to the direction of rotation 15 thereof, and it is possible in this way to pull off the sheet 1 from the blanket cylinder 2 with a reduced expenditure of force. Before the next sheet 1 is gripped, the grippers 3 and the gripper seats 10 pivot back once more until the stop 12 makes contact again. A defined sheet transfer position is always achieved thereby. The stop 9 correspondingly ensures a defined sheet forwarding position to the cylinder which follows the impression cylinder 4. The back-pivoting, which is effected by the springs 20, takes place between the forwarding of the printed sheet and the transfer of the next unprinted sheet.

Figure 2:
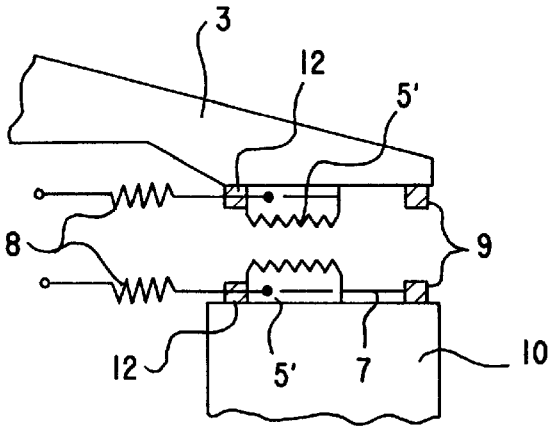
FIG. 2 is an enlarged fragmentary view of FIG. 1 showing an embodiment of the sheet-releasing device having displaceable holding blocks.

FIG. 2 shows an embodiment of the grippers 3 according to the invention having displaceable sheet-holding blocks 5'. Shown in this figure are only the gripper 3 and the gripper seat 10. The blanket cylinder 2, the impression cylinder 4 and the pull-off conditions of the sheet 1 from the blanket cylinder 2 correspond to those explained in relation to FIG. 1. Instead of the pivoting of the grippers 3 with the gripper seats 10, there occurs here a displacement of the displaceable holding blocks 5', which are arranged both on the gripper 3 and also on the gripper seat 10. In the position shown, wherein the displaceable holding blocks 5' are resting on the stops 12, the sheet is transferred by a non-illustrated sheet-guiding cylinder to the impression cylinder 4 and is gripped by the grippers 3. Then, when the leading edge of the sheet 1 passes the printing nip 6, the aforedescribed tensile force arises, and the holding blocks 5' are displaced over a predetermined travel distance represented by the double-headed arrow 7 while simultaneously tensioning the springs 8. Stops 9, which may be of adjustable construction, limit this displacement. Following the forwarding of the printed sheet, the holding blocks 5' return into the position shown. This exemplary embodiment has the advantage that it is not necessary for the entire gripper bar to be of pivotable construction. Instead of the springs 8 and the stops 9 and 12, it is possible to provide piezoelectric elements which move the holding blocks 5', as hereinaforedescribed, under electrical control.

Figure 3:
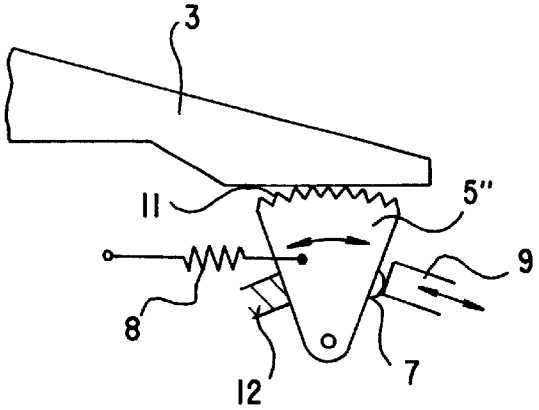
FIG. 3 is an enlarged fragmentary view of FIG. 1 showing another embodiment of the sheet-releasing device having a pivotable gripper seat.

FIG. 3 shows an embodiment having a pivotable gripper seat 5". This exemplary embodiment is also shown in the position in which it takes over a sheet 1. During this transfer, the leading end of the sheet 1 is clamped between the grippers 3 and the gripper seats 5". If the sheet 1 is then conveyed through the printing nip 6, the tensile force also arises here, and the pivotable gripper seats 5" are pivoted counter to the force of the springs 8 for a distance up to a stop 9 which, again, is of adjustable construction. With this exemplary embodiment, it is necessary for the pivotable gripper seats 5" to have a holding surface 11 having a considerably higher static friction with respect to the sheet 1 than the holding surfaces of the grippers 3 which cooperate with the gripper seats 5", because here certainly only the pivotable gripper seats 5" move and the sheet 1 must therefore slide on the grippers 3.

Figure 4:
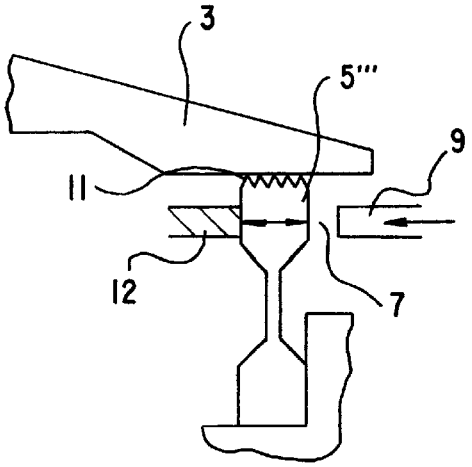
FIG. 4 is an enlarged fragmentary view of FIG. 1 showing a further embodiment of the sheet-releasing device having a sprung or resiliently mounted gripper seat.

FIG. 4 shows an embodiment having sprung gripper rests 5'''. In the case of this embodiment, the movement is achieved in that the sprung gripper rests 5''' inherently deform elastically. To this end, for example, a double T shape can be provided. This is a particularly simple embodiment, because no springs, sliding surfaces or pivots have to be provided. The stop 12 is shown, but would also not be absolutely necessary, depending upon the stiffness of the component, because the sprung gripper seats 5''' assume a defined position without any force action. However, an adjustable stop 9 is expedient in order to achieve a precise position in the deformation state. The function corresponds to that which has already been described hereinbefore.

The method of the invention may, of course, be performed by using various devices, the devices described herein, and also the refinements thereof, are only exemplary.

We claim:

1. A method of releasing a sheet from a blanket cylinder of a printing machines wherein the sheet is guided by an impression cylinder and held by grippers thereof, which comprises moving, with respect to the impression cylinder, elements of the grippers holding the sheet, in a direction relatively counter to the direction of rotation of the impression cylinder, for moving a leading edge of the sheet counter to a sheet travel direction for producing an increased pull-off angle after the leading edge of the sheet has passed a printing nip between the blanket and the impression cylinders.

2. The method according to claim 1, which includes performing the movement of the elements over a predetermined travel distance.

3. The method according to claim 2, which comprises controlling the travel distance over which the elements are moved by configuring the cylinder geometry and the nature of the printed material.

4. The method according to claim 2, wherein the travel distance is at least 0.2 mm.

5. The method according to claim 1, which includes performing the movement of the elements with a tensile force of the sheet and counter to an oppositely directed force.

6. The method according to claim 1, which comprises controlling the movement of the elements by providing adjustable stops for defining a range of movement of the elements.

7. A device for releasing a sheet from a blanket cylinder of a printing machine, wherein the sheet is guided by an impression cylinder and held by grippers of the impression cylinder, comprising grippers having holding elements disposed on the impression cylinder for holding the sheet, said holding elements being movable, with respect to the impression cylinder, in a direction relatively counter to the direction of rotation of the impression cylinder, for moving a leading edge of the sheet counter to a sheet travel direction for producing an increased pull-off angle after the leading edge of the sheet has passed a printing nip between the blanket and the impression cylinders.

8. The device according to claim 7, wherein said holding elements are constructed so as to be movable over an adjustable travel distance.

9. The device according to claim 7, including adjustable stops for impressing a movement onto said holding elements in said direction relatively counter to the direction of rotation of the impression cylinder.

10. The device according to claim 7, including a spring having a spring force connected to the impression cylinder and said grippers, said holding elements being movable by a tensile force of the sheet counter to the spring force.

11. The device according to claim 10, including an adjustable stop for limiting movement of said holding elements.

12. The device according to claim 7, including gripper seats for said grippers, said grippers and said gripper seats being pivotable.

13. The device according to claim 12, wherein said grippers and said gripper seats are equipped with displaceable holding blocks.

14. The device according to claim 7, including gripper seats for said grippers, said gripper seats being movable and being formed, opposite said grippers, with holding surfaces having a higher static friction than that of the sheet.

15. The device according to claim 14, wherein said gripper seats are pivotable.

16. The device according to claim 14, wherein said gripper seats are of yieldable construction.

17. The device according to claim 7, including a stop for limiting movement of said sheet holding elements in a sheet travel direction.

18. The device according to claim 17, wherein said stop is adjustable.

* * * * *